US007970301B2

(12) United States Patent
DeGruchy

(10) Patent No.: US 7,970,301 B2
(45) Date of Patent: Jun. 28, 2011

(54) METHODS, APPARATUS AND SYSTEMS TO COMPENSATE FOR DISTORTIONS CAUSED BY FUSING

(75) Inventor: Paul J. DeGruchy, Hilton, NY (US)

(73) Assignee: Xerox Corporation, Norwalk, CT (US)

( * ) Notice: Subject to any disclaimer, the term of this patent is extended or adjusted under 35 U.S.C. 154(b) by 390 days.

(21) Appl. No.: 12/275,648

(22) Filed: Nov. 21, 2008

(65) Prior Publication Data

US 2010/0129096 A1 May 27, 2010

(51) Int. Cl.

| | |
|---|---|
| ***G03G 15/00*** | (2006.01) |
| ***G03G 15/20*** | (2006.01) |
| ***G03G 15/045*** | (2006.01) |
| ***G03G 15/36*** | (2006.01) |
| ***G03G 15/041*** | (2006.01) |

(52) U.S. Cl. ..... 399/45; 399/44; 399/67; 399/86; 399/156; 399/182; 399/196

(58) Field of Classification Search ..... 399/44, 399/45, 67, 86, 156, 182, 196, 197, 200
See application file for complete search history.

(56) References Cited

U.S. PATENT DOCUMENTS

| | | | | |
|---|---|---|---|---|
| 6,529,643 | B1 | 3/2003 | Loce et al. | |
| 6,667,756 | B2 | 12/2003 | Conrow et al. | |
| 6,806,896 | B2 | 10/2004 | Conrow et al. | |
| 6,814,004 | B2 | 11/2004 | Lofthus et al. | |
| 6,940,536 | B2 | 9/2005 | Rauch et al. | |
| 2002/0039495 | A1 * | 4/2002 | Metzler | 399/45 |
| 2004/0086288 | A1 * | 5/2004 | Wibbels | 399/45 |
| 2006/0154161 | A1 | 7/2006 | Qi et al. | |
| 2007/0085265 | A1 | 4/2007 | DeJong et al. | |
| 2008/0089710 | A1 | 4/2008 | Lofthus et al. | |

OTHER PUBLICATIONS

U.S. Appl. No. 11/800,748, filed May 7, 2007, Ellery Wong.
U.S. Appl. No. 11/800,733, filed May 7, 2007, Ellery Wong.
U.S. Appl. No. 12/194,958, filed Aug. 20, 2008, Kulkarni et al.
U.S. Appl. No. 12/059,170, filed Mar. 21, 2008, Michael Mongeon.

* cited by examiner

*Primary Examiner* — David M Gray
*Assistant Examiner* — Joseph S Wong
(74) *Attorney, Agent, or Firm* — Fay Sharpe LLP

(57) ABSTRACT

Disclosed are printing methods, apparatus and systems to compensate for distortion caused by fusing toner to a media substrate. According to one exemplary embodiment, the method includes processing image data according to media characterization data for a measured fuser temperature. The media characterization data provides a basis to compensate for media substrate shrinkage due to fusing the printed image on the media substrate.

23 Claims, 8 Drawing Sheets

STEPS IN DETERMINING THE PAPER DISTORTION FOR A SPECIFIC PAPER FOR THE CASES: 1) DISTORTION OBSERVED WITH A STABLE UNIFORM FUSER CONDITION; AND 2) DISTORTION OBSERVED WITH VARIOUS LEVELS OF TEMPERATURE NON-UNIFORMITY DELTA ACROSS THE LENGTH OF A RUN TO BE USED TO CREATE DATA BASE.

METHODS, APPARATUS AND SYSTEMS TO COMPENSATE FOR DISTORTIONS CAUSED BY FUSING

CROSS REFERENCE TO RELATED PATENTS AND APPLICATIONS

U.S. patent application Ser. No. 12/276,555, filed Nov. 24, 2008, by DeGruchy et al., entitled "METHODS, SYSTEMS AND APPARATUS TO COMPENSATE FOR DISTORTIONS CAUSED BY FUSING" is incorporated herein by reference in its entirety.

BACKGROUND

This disclosure relates to printing methods, systems and apparatus to compensate for distortion caused by fusing toner applied to a media substrate. According to one exemplary method, image data is processed according to media characterization data for a measured fuser temperature to compensate for media substrate shrinkage due to fusing a printed image on the media substrate.

Electrophotographic marking is a well-known and commonly used method of copying or printing documents. In general, electrophotographic marking employs a charge-retentive, photosensitive surface, known as a photoreceptor, that is initially charged uniformly. In an exposure step, a light image representation of a desired output focused on the photoreceptor discharges specific areas of the surface to create a latent image. In a development step, toner particles are applied to the latent image, forming a toner or developed image. This developed image on the photoreceptor is then transferred to a print sheet on which the desired print or copy is fixed.

The electrophotographic marking process outlined above can be used to produce color as well as black and white (monochrome) images. Generally, color images are produced by repeating the electrophotographic marking process to print two or more different image layers or color image separations in superimposed registration on a single print sheet. This process may be accomplished by using a single exposure device, e.g. a raster output scanner (ROS), where each subsequent image layer is formed on a subsequent pass of the photoreceptor (multiple pass) or by employing multiple exposure devices, each writing a different image layers, during a single revolution of the photoreceptor (single pass). While multiple pass systems require less hardware and are generally easier to implement than single pass systems, single pass systems provide much greater print speeds.

In generating color images, the ability to achieve precise registration of the image layers is necessary to obtain printed image structures that are free of undesirable color fringes and other registration errors. In addition, when generating duplex printed documents, registration of images on a document is important where individual sheets or pages are bound. For example, in duplex printing of sheets or pages intended for binding, in order to provide a quality print job which is competitive in the market place, it is necessary that the print on both sides of the pages be registered or positioned on the page such that there is no noticeable variation to the reader of the print on the page from the first to the second side. It has been found that variations of 2 mm or less in the image registration from Side 1 to Side 2 of a sheet or page are quite noticeable to the eye of the reader and give the impression of a poor quality print job. Accordingly, it has been found necessary to maintain very tight control of the image magnification or registration in duplex printing from Side 1 to Side 2, or front to back, of the printed media sheet.

Maintaining the aforesaid tight control of print magnification from Side 1 to Side 2 in a duplex printing job on an electrostatic photocopier has proven to be difficult and costly in such machines set up for high speed duplex printing. This has been found to be the case irrespective of whether the digital image is transferred directly to the electrostatic printing machine such as from a computer or is generated from a printed sheet inputted for copying and reproduction. The complexity of the processes within the electrostatic print engine including the transport of the paper through the sheet path and heat fusing in the print engine has introduced error in the print magnification and registration from Side 1 to Side 2 on a printed sheet.

One cause of misregistration of printed images on a xerographic printer is that paper media gets distorted as it passes through a fuser. It is desirable to have methods, apparatus and systems to compensate for distortions caused by fusing.

INCORPORATION BY REFERENCE

U.S. Pat. No. 6,529,643, issued Mar. 4, 2008, to Loce et al., entitled "SYSTEM FOR ELECTRONIC COMPENSATION OF BEAM SCAN TRAJECTORY DISTORTION";

U.S. Pat. No. 6,940,536, issued Sep. 6, 2005, to Rauch et al., entitled "SYSTEM ARCHITECTURE FOR SCAN LINE NON-LINEARITY COMPENSATION IN A ROS SYSTEM";

U.S. Pat. No. 6,667,756, issued Dec. 23, 2003, to Conrow et al., entitled "METHOD OF SHIFTING AN IMAGE OR PAPER TO REDUCE SHOW THROUGH IN DUPLEX PRINTING";

U.S. Pat. No. 6,806,896, issued Oct. 19, 2004, to Conrow et al., entitled "METHOD OF SHIFTING AN IMAGE OR PAPER TO REDUCE SHOW THROUGH IN DUPLEX PRINTING";

U.S. Pat. No. 6,814,004, issued Nov. 9, 2004, to Loftus et al., entitled "FACE-TO-FACE PRINTING WITHIN BOOKLET";

U.S. Patent Publication No. 2008/0089710, published Apr. 17, 2008, to Loftus et al., entitled "FACE-TO-FACE PRINTING WITHIN BOOKLET";

U.S. Patent Publication No. 2006/0154161, Published Jul. 13, 2006, to Qi et al., entitled "CROSSLINKED SILOXANE OUTMOST LAYER HAVING AROMATIC SILICONCONTAINING COMPOUNDS FOR PHOTORECEPTOR";

U.S. Patent Publication No. 2007/0085265, published Apr. 19, 2007, to DeJong et al., entitled "DUPLEX REGISTRATION ON SYSTEMS AND METHODS";

U.S. patent application Ser. No. 11/800,748, filed May 7, 2007, by Ellery Wong, entitled "METHOD OF ADJUSTMENT CONTROL FOR IMAGE ALIGNMENT";

U.S. patent application Ser. No. 11/800,733, filed May 7, 2007, to Ellery Wong, entitled "IMAGE ADJUSTMENT CONTROL FOR IMAGE ALIGNMENT";

U.S. patent application Ser. No. 12/194,958, filed Aug. 20, 2008, to Kulkarni et al., entitled "METHOD TO IMPROVE IMAGE ON PAPER REGISTRATION MEASUREMENTS"; and U.S. patent application Ser. No. 12/059,170, filed Mar. 31, 2008, to Michael Mongeon, entitled "METHOD AND APPARATUS FOR IMAGE REGISTRATION FOR IMAGE PROCESSING";

are incorporated totally herein by reference in their entirety.

BRIEF DESCRIPTION

In one embodiment of this disclosure, a method is disclosed of printing an image that compensates for distortion caused by fusing toner applied to a media substrate comprising A) receiving image data representing an image for printing on a printing device, the printing device including an image transfer point and a fuser; B) measuring the fuser temperature; C) accessing media characterization data, the media characterization data including media shrinkage data associated with the media substrate relative to the fuser temperature; D) processing the image data according to the media characterization data for the measured fuser temperature to compensate for media substrate shrinkage due to fusing the printed image on the media substrate; E) printing the image on the media substrate at the image transfer point using the processed image data; and F) fusing the printed image on the media substrate.

In another embodiment of this disclosure, a computer program product is disclosed. The computer program product comprises a computer-usable data carrier storing instructions that, when executed by a computer, cause the computer to perform a method of processing an image that compensates for distortion caused by fusing toner applied to a media substrate comprising A) receiving image data representing an image for printing on a printing device, the printing device including an image transfer point and a fuser; B) measuring the fuser temperature; C) accessing media characterization data, the media characterization data including media shrinkage data associated with the media substrate relative to the fuser temperature; and D) processing the image data according to the media characterization data for the measured fuser temperature to compensate for media substrate shrinkage due to fusing the printed image on the media substrate.

In still another embodiment of this disclosure, a printing system is disclosed. The printing system comprises a printing device including a fuser, and an image transfer point, a controller operatively connected to the printing device, the controller configured to execute a method of printing an image that compensates for distortion caused by fusing toner applied to a media substrate comprising A) receiving image data representing an image for printing on one of the one or more printing devices, B) measuring the fuser temperature; C) accessing media characterization data, the media characterization data including media shrinkage data associated with the media substrate relative to the fuser temperature; D) processing the image data according to the media characterization data for the measured fuser temperature to compensate for media substrate shrinkage due to fusing the printed image on the media substrate; E) printing the image on the media substrate at the image transfer point using the processed image data; and F) fusing the printed image on the media substrate.

DETAILED DESCRIPTION

As briefly discussed in the background section, the registration of printed images on a document, i.e. media substrate or media, can be critical for color printing and duplex printing of documents which will be bound side by side.

One cause of misregistration is paper gets distorted as it passes through a fuser. This is largely seen as shrinkage caused from moisture being driven out of the media at high temperatures. Changes can also occur in the media due to the high nip strain that affects its mechanical properties. When side one is imaged and fused, then re-circulated for imaging side two, the sheet size has changed and therefore adversely affects the front to back registration. Furthermore, if the fuser temperature uniformity across the roll becomes non-uniform during the course of a run, the media distortion pattern can change significantly and the distortion becomes much more nonlinear. With very tight goals of micron registration these changes in media distortion within a run becomes significant. Temperature uniformity variation within a run can change the mean media distortion by several hundred microns. In some printers, this change occurs over the first 5 to 6 hundred sheets before reaching steady state. If the run is interrupted it will pick up at a new current fuser state.

Some solutions to media shrinkage include a printer setup procedure whereby x-y margin shift and image mag (magnification) can be adjusted IOP (image on paper). This may be accomplished by use of media property LUTs (look-up-tables) which try to center the mag error caused from the media shrinkage.

This disclosure and the embodiments thereof address IOP registration errors caused by media substrate distortion.

As previously stated, the temperature uniformity across the fuser roll can change significantly during the course of a run from the media drawing heat locally out of the roll as it passes. This causes the media distortion pattern to change significantly and become more nonlinear. The following disclosure provides techniques of pre-characterizing the media distortion variation trends as a function of the temperature uniformity change. The temperature delta across the roll can then be monitored throughout the run and dynamic image distortion compensation algorithms can be applied to the image with a VCSEL (Vertical Cavity Surface Emitting Laser) ROS based on the change in the temperature uniformity measurement. The continuous monitoring of the fuser temperature change allows for interruptions during a run or continuous workflow of various jobs without returning the fuser to a known steady state standby condition. The image correction algorithm will always apply corrections based on the present fuser state. By monitoring the fuser temperature uniformity condition and applying dynamic image compensation accordingly, several hundred microns of improved IOP registration can be achieved.

Figure 4:
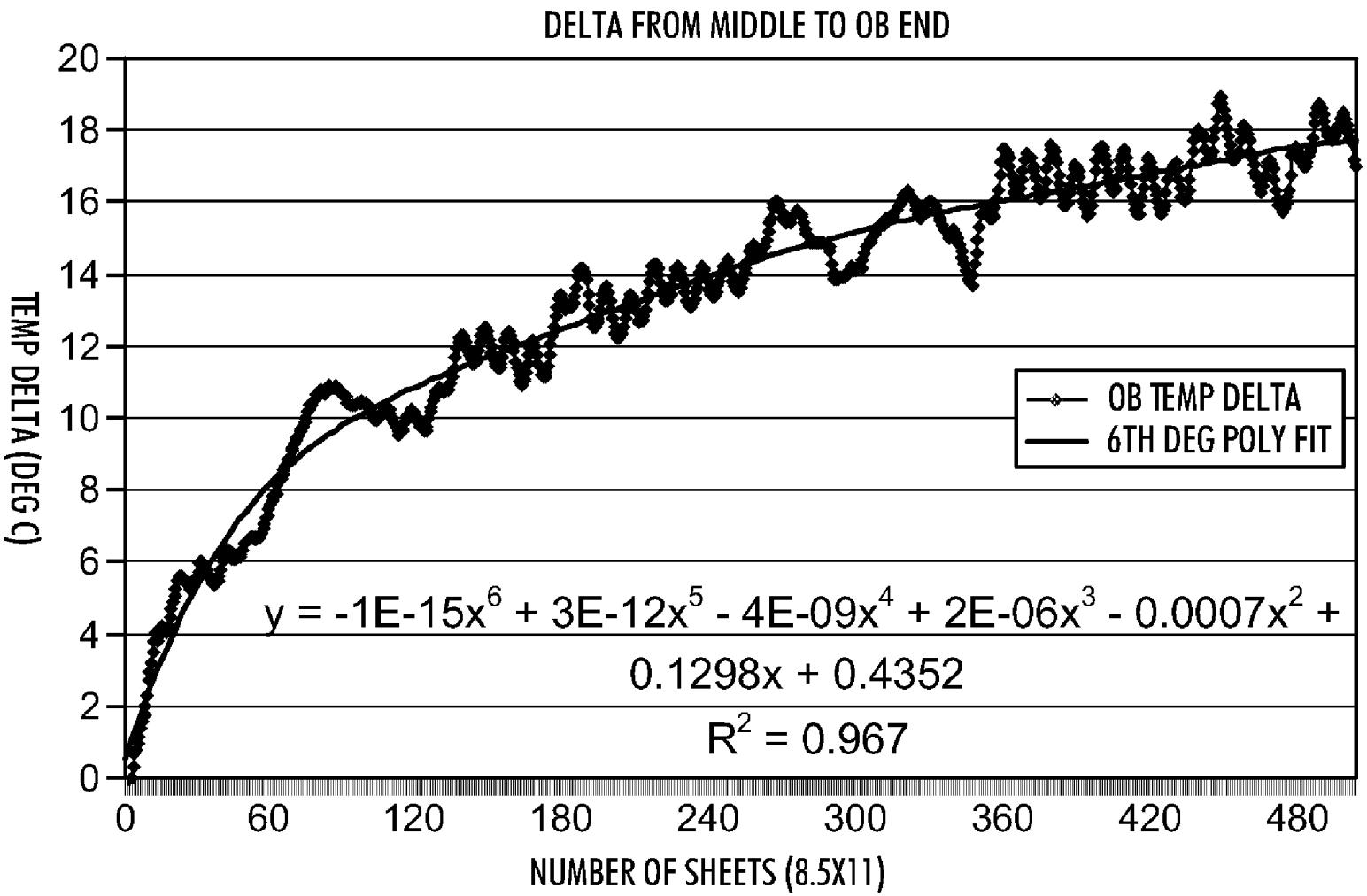
FIG. 4 is a graph of one example of fuser temperature delta from the middle to the OD (outboard) end of the fuser.

With reference to FIG. 4, illustrated is temperature data collected for a fuser associated with a printer.

As seen, temperature uniformity, i.e., temperature differential, across the fuser roll, can change significantly during the course of a run from the media drawing heat locally out of the roll as it passes. The fuser used to collect the data of FIG. 4 has one single element heating lamp serving a center registered 13 inch wide media path. When fusing narrow media, the lamp must maintain the temperature across the media width, causing the ends outside that width to rise in temperature. For an 8.5×11 90 gsm media run LEF that temperature differential reaches about 18 degrees C. and take 600 sheets to reach a steady state condition. Notably, the same media run SEF the differential will reach 31 degrees C. This increased end temperature conducts inward and causes the ends of the media to be fused at a higher temperature. This differential causes the media distortion pattern to change significantly and generally causes the distortion to become more nonlinear.

With reference to FIGS. 5-8, illustrated are plots of media shrinkage for a test target. The target was pre-printed using an ink jet printer as to preserve the original properties of the media. The test target was scanned, run through a xerographic printer including a fuser, and immediately scanned after exiting the printer. The difference between the two scans yields the media distortion resulting from the fuser. This distortion represents the image distortion that would be seen as front to back image registration error from fusing for a duplex print if no error corrections are applied.

Figure 5:
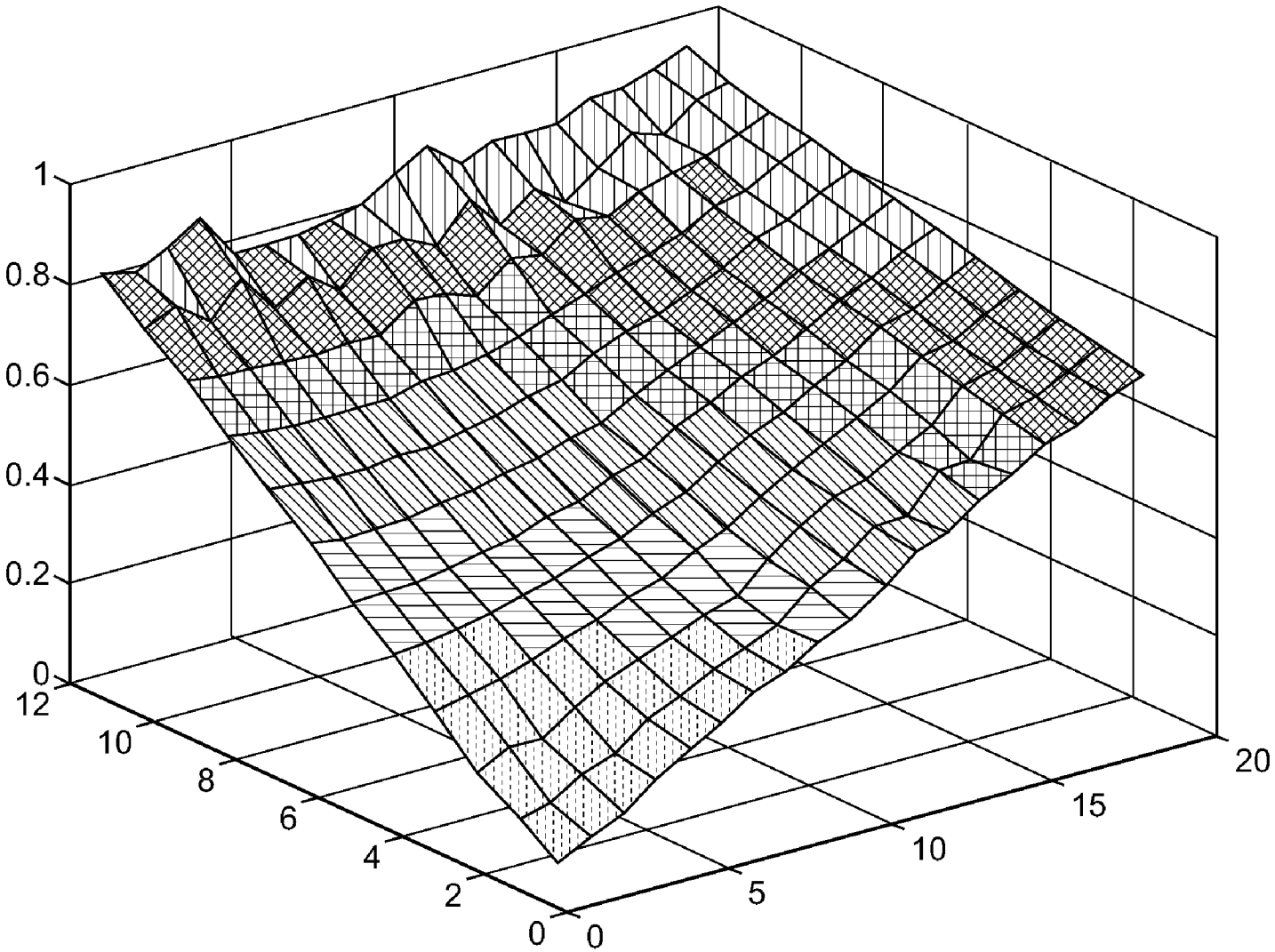
FIG. 5 is a graph of the media distortion associated with one type of media subsequent to a fusing process.

As can be seen from FIG. 5, the media shrink almost 1 mm from the first pass through the fuser. Consequently, the side 2 image will be transferred to a respectively smaller image that was previously printed on the front, resulting in front to back image registration error.

Figure 6:
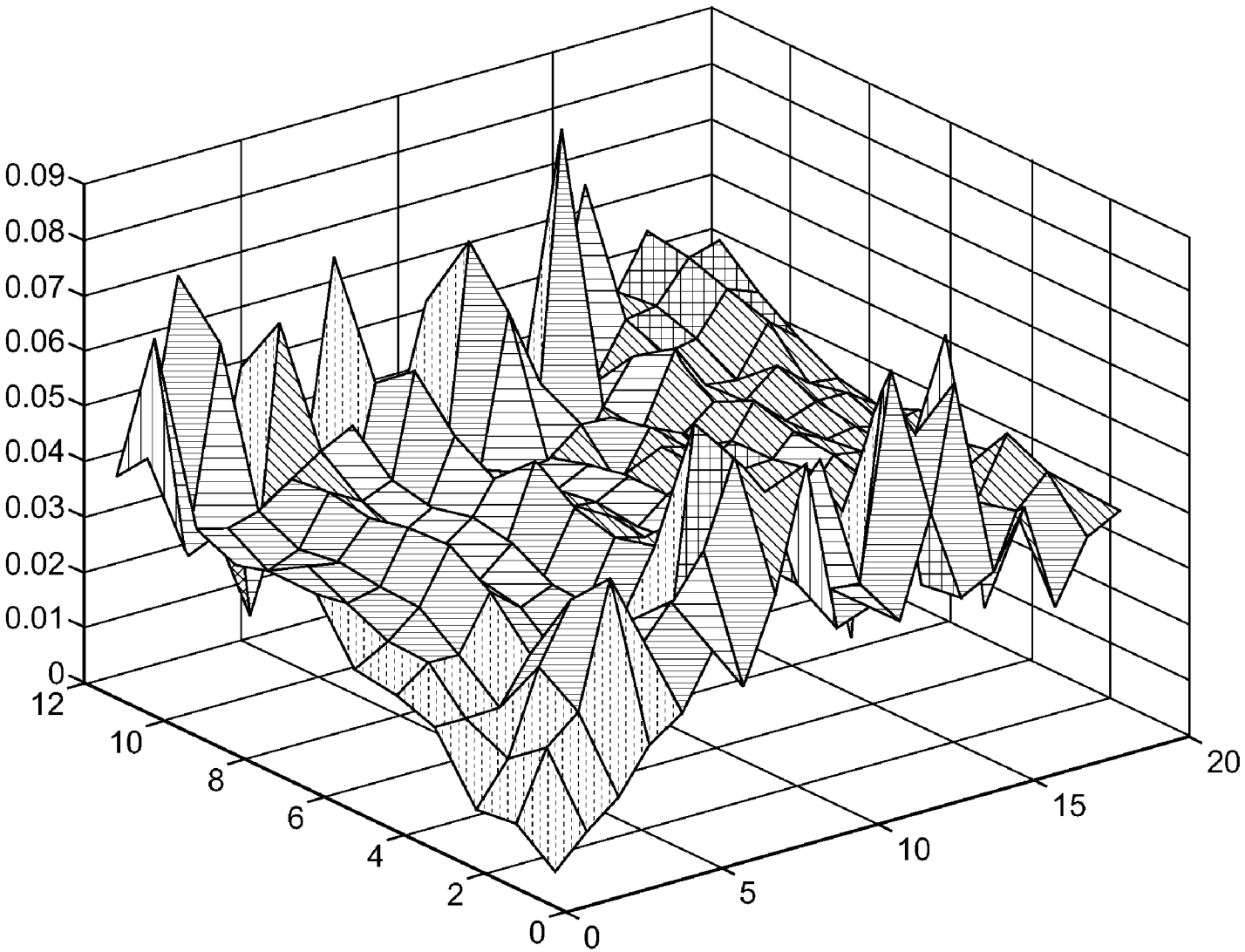
FIG. 6 is a graph of the distortion of a printed test image after a first run where the average linear and nonlinear magnification is removed.

With reference to FIG. 6, illustrated is a plot of media shrinkage/distortions for a typical start of run after removing average linear and nonlinear errors. This data was collected by applying registration test procedure whereby 5-10 duplex target prints are run, scanned and analyzed. Image compensation parameters to correct for the total average errors are then calculated and applied to subsequent printing jobs through a VCSEL ROS. Notably, these corrections were based on a uniform fuser temperature across the fuser roll since they were measured from a steady state idle fuser condition. These corrections will properly be applied at the beginning of the print job, but as the fuser roll temperature uniformity changes throughout the run, the applied error corrections will go out of sync with the changes in the media distortion.

Figure 7:
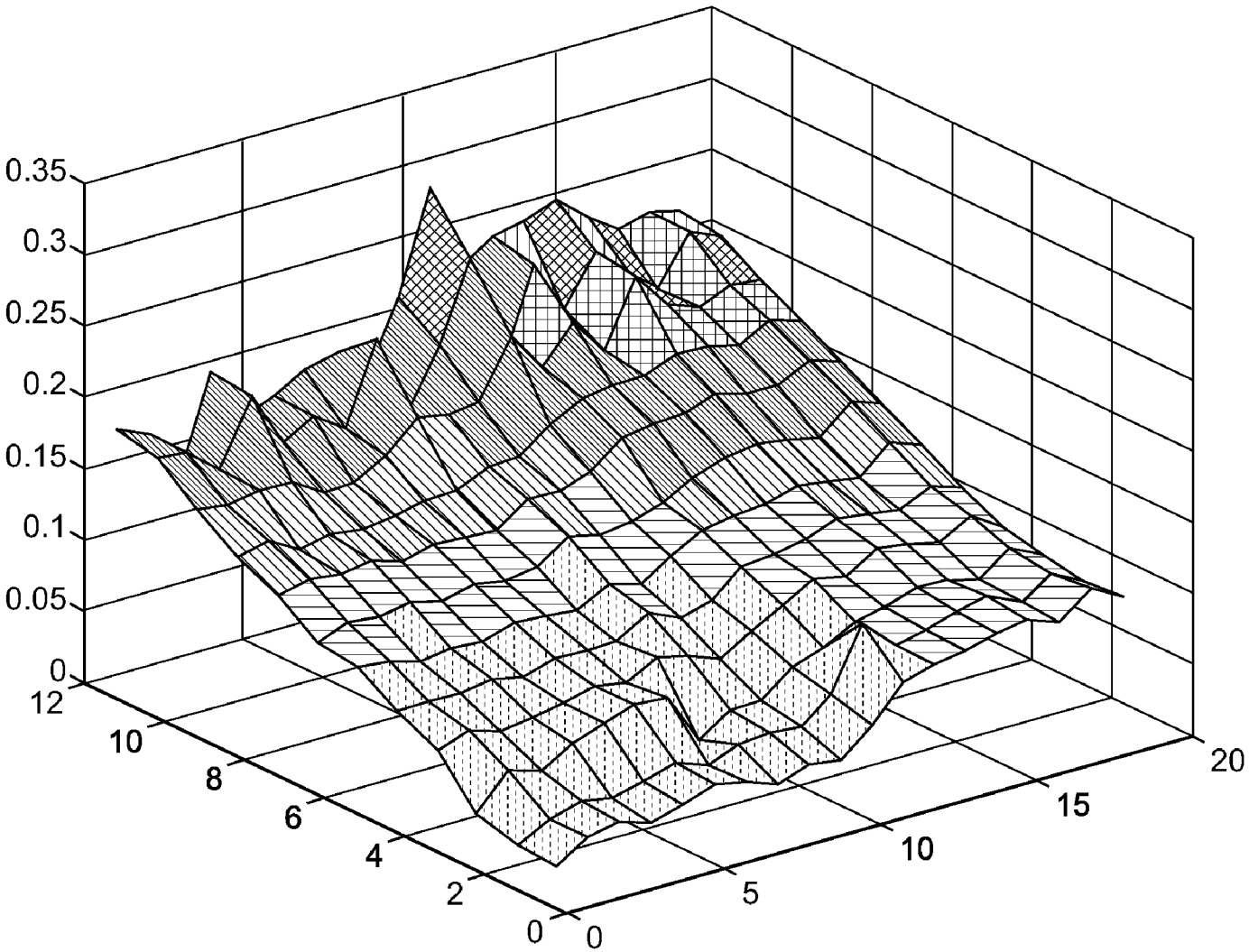
FIG. 7 is a graph of the distortion of a simulated printed test image after running 600 prints where the average linear and nonlinear magnification associated with a first run is removed.

With reference to FIG. 7, illustrated is a plot of a typical media distortion after a 600 sheet run, after removing average linear and nonlinear error. The average linear and nonlinear error correction applied was determined based on the average error measured at the beginning of the run. Notably, the resultant front to back image distortion increased by approximately 150 microns.

By characterizing different media distortion changes as a function of the fuser roll temperature uniformity condition and applying the disclosed techniques to the examples shown in FIGS. 5-7, image correction can be continuously modified based on the actual fuser roll temperature condition. Therefore the same front to back registration results can be maintained through the duration of the run.

Figure 8:
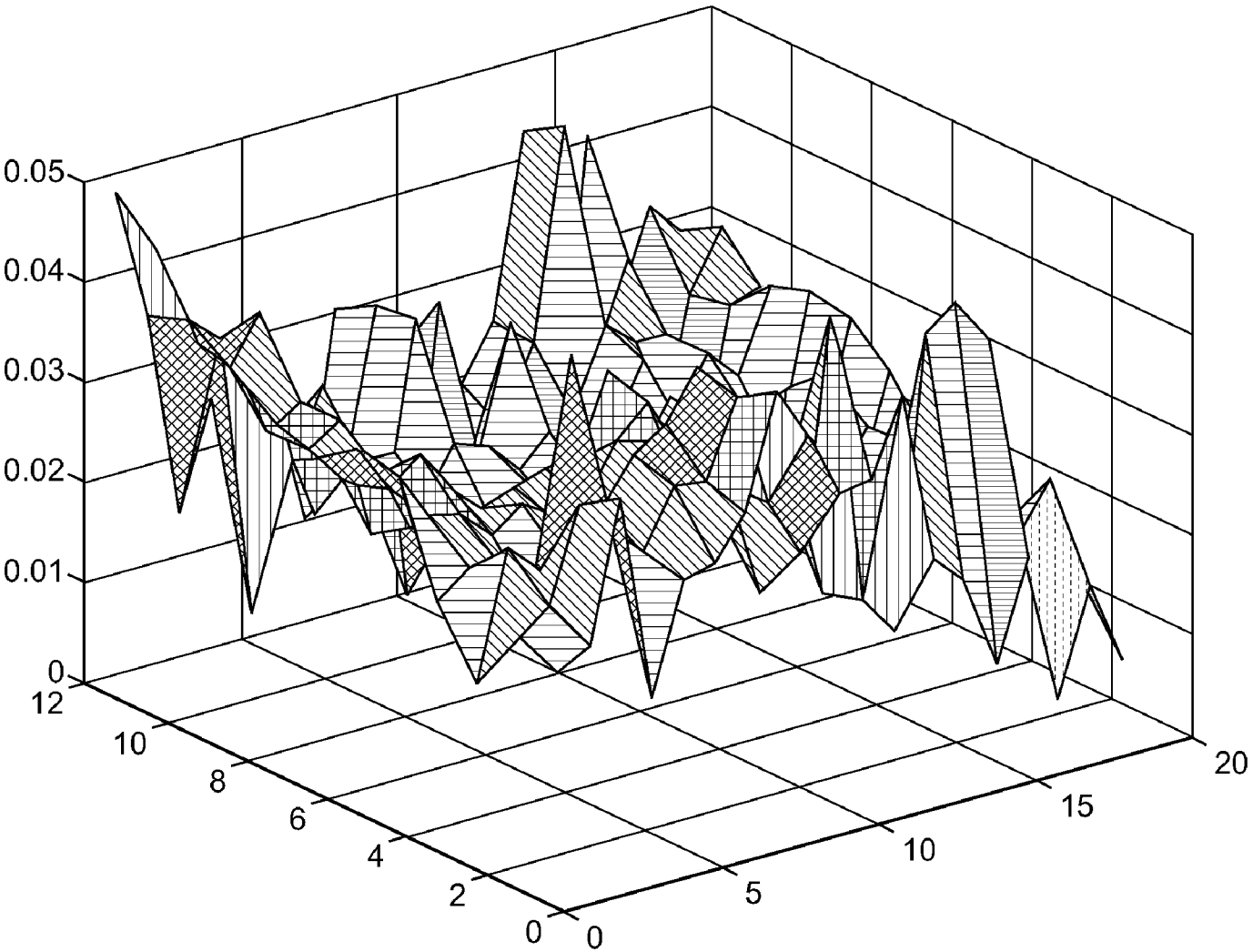
FIG. 8 is a graph of the distortion of a simulated printed test page after running 600 prints where the average linear and nonlinear errors associated with the 600th print is removed.

With reference to FIG. 8, illustrated is a plot of a typical media distortion after a 600 sheet run, after removing average linear and nonlinear error when the average error correction applied to the media was determined based on the average error measured at 600 sheet conditions. This plot illustrates that registration systems applying average error correction that dynamically tracks the fuser temperature condition can produce low errors. Consequently, the change in media distortion throughout the run will remain transparent to the front to back registration.

Substantively, the exemplary embodiments of methods, apparatus and systems to compensate for distortions caused by fusing operate as follows: receiving image data representing an image for printing on a printing device, the printing device including an image transfer point and a fuser; measuring the fuser temperature; accessing media characterization data, the media characterization data including media shrinkage data associated with the media substrate relative to the fuser temperature; processing the image data according to the media characterization data for the measured fuser temperature to compensate for media substrate shrinkage due to fusing the printed image on the media substrate; printing the image on the media substrate at the image transfer point using the processed image data; and fusing the printed image on the media substrate.

According to one exemplary embodiment, the media characterization data is assembled in a LUT (Look-Up Table) which includes media shrinkage correction data relative to a plurality of predetermined fuser temperatures. To acquire media correction data for fuser temperatures intermediate to the predetermined temperatures, interpolation can be used. Likewise, extrapolation can be used to acquire media correction data for fuser temperatures just outside of the predetermined temperature range.

Figure 1:
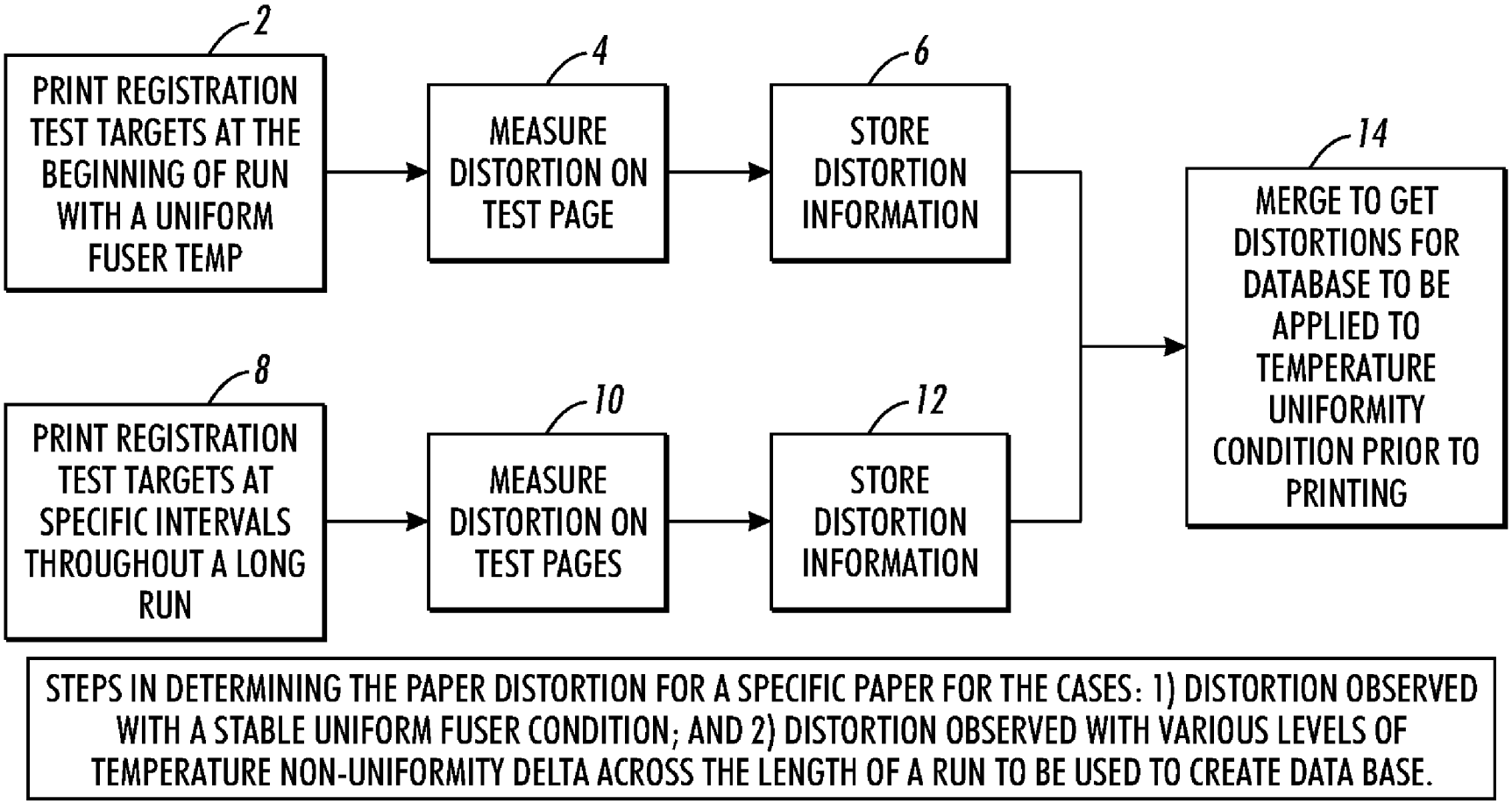
FIG. 1 is a flow chart of an exemplary method of printing an image that compensates for distortion caused by fusing toner applied to a media substrate according to this disclosure.

With reference to FIG. 1, a flow chart of an exemplary method of printing an image is shown that compensates for distortion caused by fusing toner applied to a media substrate.

Initially, at 2 print registration test targets at the beginning of a run with a uniform fuser temp.

Next, at 4 measure the distortion on the test page.

Next, at 6 store the distortion information in a data storage device, e.g., computer, DFE, printer controller, etc.

Next, at 8 print registration test targets at specific intervals throughout a long print run, e.g., throughout a 600 sheet run.

Next, at 10 measure the distortion on the test pages.

Next, at 12 store the distortion information in a data storage device.

Finally, at 14 merge the stored distortion information to compile a database to be applied to measured temperature uniformity condition prior to printing.

In effect, the final merged distortion information will include 1) distortion observed with a stable uniform fuser condition; and 2) distortion observed with various levels of temperature non-uniformity delta across the length of a run.

Figure 2:
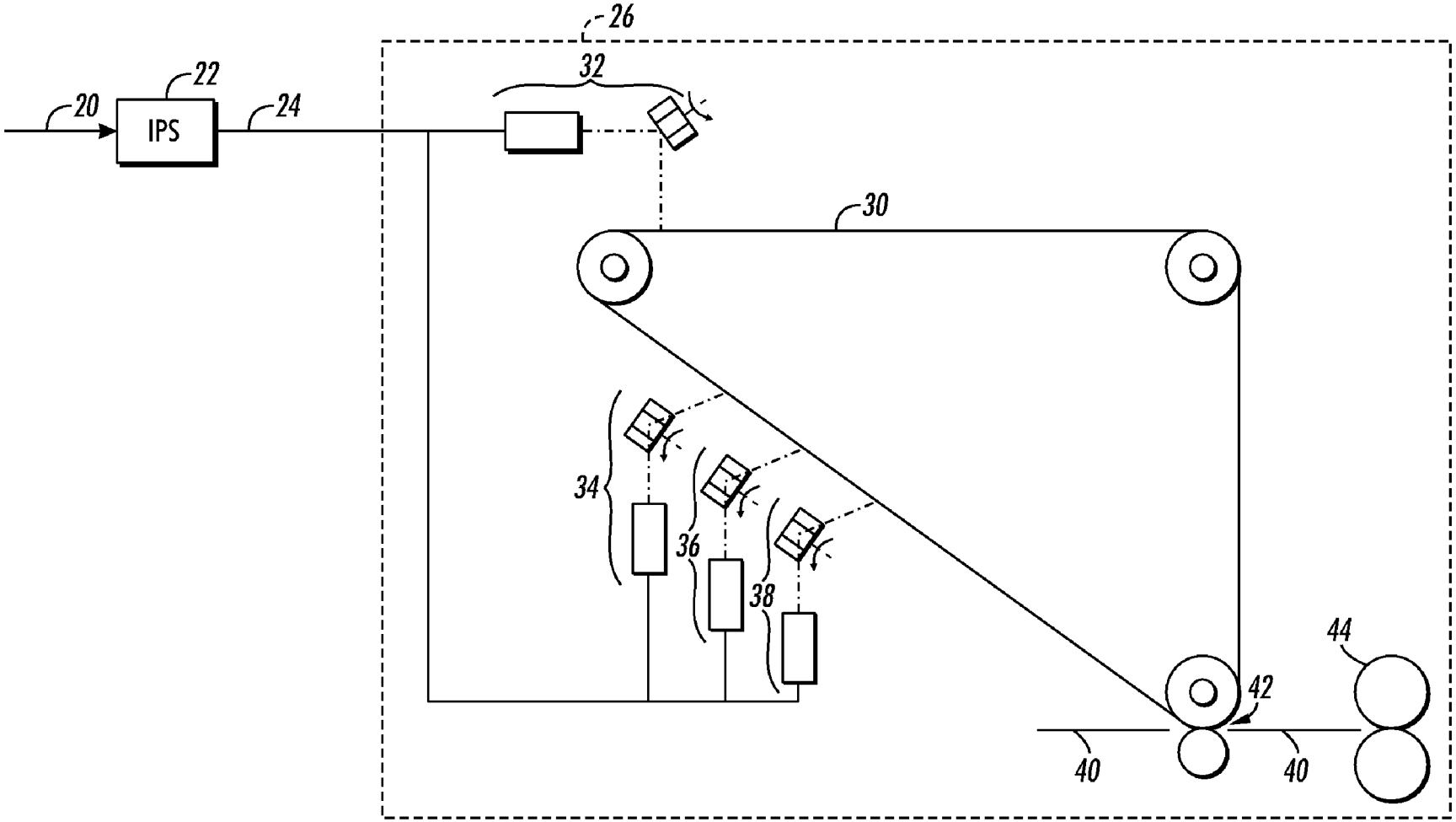
FIG. 2 is a block diagram of an exemplary embodiment of a printing system that compensates for distortion caused by fusing toner applied to a media substrate according to this disclosure.

With reference to FIG. 2, a block diagram of an exemplary embodiment of a printing system is shown that compensates for distortion caused by fusing toner applied to a media substrate.

The embodiment shown is a printing machine including a digital imaging system that incorporates the distortion compensation methods disclosed. In operation, image data 20 representing an image to be printed is received by an IPS (Image Processing System) 22 that may incorporate what is commonly referred to as DFE (Digital Front End). IPS 22 processes the received image data 20 to produce print ready binary data 24 that is supplied to a print engine 26. A media sheet 40 is routed to the image transfer point 42 and subsequently fused by fuser 44.

IPS 22 may receive image data 20 from an input scanner which captures an image from an original document, a computer, a network, or any similar or equivalent image input terminal communicating with imaging system 5. Print engine 26 is beneficially an electrophotographic engine; however, it will become evident from the following discussion that the exemplary embodiments are useful in a wide variety of copying and printing machines and is not limited in its application to the printing machine shown herein. Print engine 26 is shown as a multi-ROS engine which operates on the print ready binary data from IPS 22 to generate a color document in a single pass on a charge retentive surface in the form of photoreceptor belt 30. Briefly, the uniformly charged photoreceptor 30 is initially exposed to a light image which represents a first color image separation, such as black, at ROS 32. The resulting electrostatic latent image is then developed with black toner particles to produce a black toner image. This same image area with its black toner layer is then recharged, exposed to a light image which represents a second color separation such as yellow at ROS 34, and developed to produce a second color toner layer. IOI (image on image) process may be repeated at ROS 36 and ROS 38 to subsequently develop image layers of different colors, such as magenta and cyan.

Figure 3:
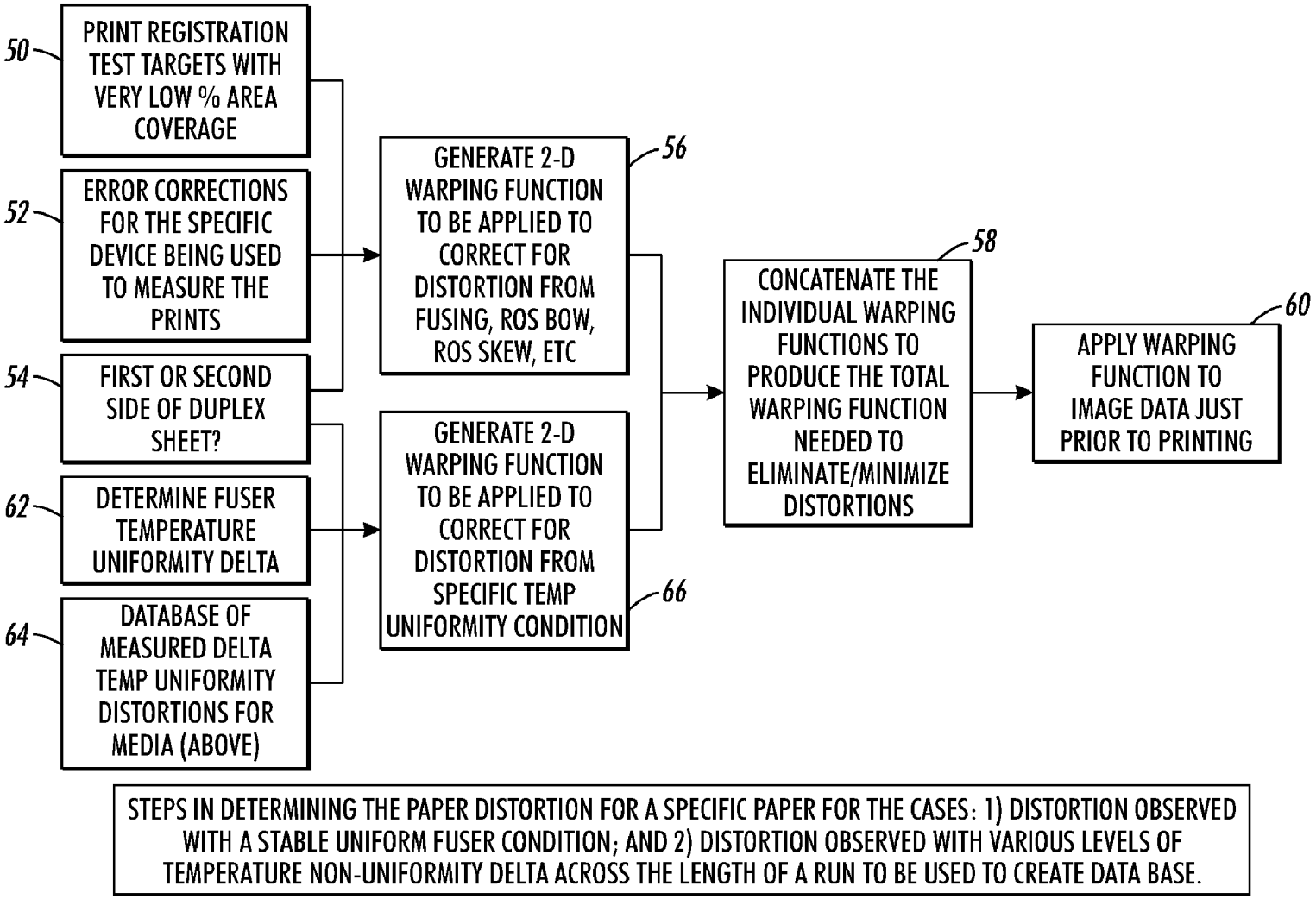
FIG. 3 is a flow chart of an exemplary method of processing an image that compensates for distortion caused by fusing toner applied to a media substrate according to this disclosure.

With reference to FIG. 3, a flow chart of an exemplary method of processing an image is shown that compensates for distortion caused by fusing toner applied to a media substrate.

Initially, at 50 the process prints registration targets with very low % area of toner coverage using an ink jet printer.

Next, at 52, generate error correction for the specific printing device being used for the measured prints.

Next, at 54 indicate which side of duplex sheet is being printed.

At 56, the process generates a 2-D warping function to be applied to the image to correct for distortion from fusing, ROS bow, ROS skew, etc.

At 66, the process generates a 2-D warping function based on the indicated duplex sheet side at 54, the fuser temperature uniformity data at 62 and the database of measured delta temp uniformity correlated with media distortion data at 64. The 2-d warping function applied at 66 corrects for distortion for the specific temperature uniformity condition present at, or very near the time of printing.

At 58, the process concatenates the individual warping functions to produce the total warping function needed to eliminate/minimize distortions.

At 60, the process applies the warping function to the image data just prior to printing.

A detailed description of the operation of a warping processor is disclosed in U.S. Pat. No. 6,529,643.

In general, the warping processor realigns the pixels in contone image into warped scanlines that compensate for distortions in the beam scan trajectory of a ROS and, according to these other distortion disclosure, caused by media distortion. For each warped pixel, a warping processor identifies the output position of the warped pixel and identifies those pixels within the contone image data that will compensate for the distortions.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of printing an image that compensates for distortion caused by fusing toner applied to a media substrate comprising:

A) receiving image data representing an image for printing on a printing device, the printing device including an image transfer point and a fuser;

B) measuring the temperature uniformity of the fuser from one area of the fuser to a second area of the fuser;

C) accessing media characterization data, the media characterization data including media shrinkage data associated with the media substrate relative to the temperature uniformity of the fuser;

D) processing the image data according to the media characterization data for the measured temperature uniformity of the fuser to compensate for media substrate shrinkage due to fusing the printed image on the media substrate;

E) printing the image on the media substrate at the image transfer point using the processed image data; and F) fusing the printed image on the media substrate.

2. The method of claim 1, wherein the media characterization data includes media substrate shrinkage data associated with a plurality of media substrates and a plurality of fuser temperatures.

3. The method of claim 1, wherein step A) includes receiving pixel image data representing the image for printing on the printing device, step D) includes processing the pixel image data to adjust one or more pixel values according to the media characterization data for the measured fuser temperature to compensate for media substrate shrinkage due to fusing the printed image on the media substrate, and step E) includes printing the image on the media substrate at the image transfer point using the processed pixel image data.

4. The method of claim 1, wherein the media characterization data is assembled in a LUT (look-up-table).

5. The method of claim 4, wherein an interpolation step is applied to the media characterization data assembled in the LUT.

6. The method of claim 1, wherein the media characterization data is generated for a plurality of media substrate types which vary in composition, each media substrate type being fused at a plurality of fuser temperatures, and the media substrate types measured for shrinkage subsequent to fusing.

7. The method of claim 6, wherein the characterization data is generated by averaging each media substrate type shrinkage associated with the plurality of fuser temperatures.

8. The method of claim 6, wherein each media substrate type is fused at a plurality of temperature uniformity conditions associated with the fuser.

9. A method of printing an image that compensates for distortion caused by fusing toner applied to a media substrate comprising:

A) receiving image data representing an image for printing on a printing device, the printing device including an image transfer point and a fuser;

B) measuring the fuser temperature;

C) accessing media characterization data, the media characterization data including media shrinkage data associated with the media substrate relative to the fuser temperature;

D) processing the image data according to the media characterization data for the measured fuser temperature to compensate for media substrate shrinkage due to fusing the printed image on the media substrate;

E) printing the image on the media substrate at the image transfer point using the processed image data; and F) fusing the printed image on the media substrate, wherein, the media characterization data is generated for a plurality of media substrate types which vary in composition, each media substrate type being fused at a plurality of fuser temperatures, and the media substrate types measured for shrinkage subsequent to fusing, wherein each media substrate type is fused at a plurality of temperature uniformity conditions associated with the fuser, and wherein the characterization data is generated by averaging each media substrate type shrinkage associated with the plurality of fuser temperature uniformity conditions.

10. A computer program product comprising:

a non-transitory computer-usable data carrier storing instructions that, when executed by a computer, cause the computer to perform a method of processing an image that compensates for distortion caused by fusing toner applied to a media substrate comprising:

A) receiving image data representing an image for printing on a printing device, the printing device including an image transfer point and a fuser;

B) measuring the temperature uniformity of the fuser from one area of the fuser to a second area of the fuser;

C) accessing media characterization data, the media characterization data including media shrinkage data associated with the media substrate relative to the temperature uniformity of the fuser; and D) processing the image data according to the media characterization data for the measured temperature uniformity of the fuser to compensate for media substrate shrinkage due to fusing the printed image on the media substrate.

11. The computer program product according to claim 10, wherein the media characterization data includes media substrate shrinkage data associated with a plurality of media substrates and a plurality of fuser temperatures.

12. The computer program product according to claim 10, wherein step A) includes receiving pixel image data representing the image for printing on the printing device, and step D) includes processing the pixel image data to adjust one or more pixel values according to the media characterization data for the measured fuser temperature to compensate for media substrate shrinkage due to fusing the printed image on the media substrate.

13. The computer program product according to claim 10, wherein the media characterization data is assembled in a LUT.

14. The computer program product according to claim 13, wherein an interpolation step is applied to the media characterization data assembled in the LUT.

15. The computer program product according to claim 10, wherein the media characterization data is generated for a plurality of media substrate types which vary in composition, each media substrate type being fused at a plurality of fuser temperatures, and the media substrate types measured for shrinkage subsequent to fusing.

16. The computer program product according to claim 15, wherein the characterization data is generated by averaging each media substrate type shrinkage associated with the plurality of fuser temperatures.

17. The computer program product according to claim 15, wherein each media substrate type is fused at a plurality of temperature uniformity conditions associated with the fuser.

18. The computer program product according to claim 17, wherein the characterization data is generated by averaging each media substrate type shrinkage associated with the plurality of fuser temperature uniformity conditions.

19. A printing system comprising:

a printing device including a fuser and an image transfer point, a controller operatively connected to the printing device, the controller configured to execute a method of printing an image that compensates for distortion caused by fusing toner applied to a media substrate comprising:

A) receiving image data representing an image for printing on one or more printing devices, B) measuring the temperature uniformity of the fuser from one area of the fuser to a second area of the fuser;

C) accessing media characterization data, the media characterization data including media shrinkage data associated with the media substrate relative to the temperature uniformity of the fuser;

D) processing the image data according to the media characterization data for the measured temperature uniformity of the fuser to compensate for media substrate shrinkage due to fusing the printed image on the media substrate;

E) printing the image on the media substrate at the image transfer point using the processed image data; and F) fusing the printed image on the media substrate.

20. The printing system according to claim 19, wherein step A) includes receiving pixel image data representing the image for printing on the printing device, step D) includes processing the pixel image data to adjust one or more pixel values according to the media characterization data for the measured fuser temperature to compensate for media substrate shrinkage due to fusing the printed image on the media substrate, and step E) includes printing the image on the media substrate at the image transfer point using the processed pixel image data.

21. The printing system according to claim 19, wherein the media characterization data is assembled in a LUT.

22. The printing system according to claim 21, wherein an interpolation step is applied to the media characterization data.

23. A printing system comprising:

a printing device including a fuser and an image transfer point, a controller operatively connected to the printing device, the controller operatively connected to the printing device, the controller configured to execute a method of printing an image that compensates for distortion caused by fusing toner applied to a media substrate comprising:

A) receiving image data representing an image for printing on a printing device, the printing device including an image transfer point and a fuser;

B) measuring the fuser temperature;

C) accessing media characterization data, the media characterization data including media shrinkage data associated with the media substrate relative to the fuser temperature;

D) processing the image data according to the media characterization data for the measured fuser temperature to compensate for media substrate shrinkage due to fusing the printed image on the media substrate;

E) printing the image on the media substrate at the image transfer point using the processed image data; and F) fusing the printed image on the media substrate, wherein the media characterization data is generated for a plurality of media substrate types which vary in composition, each media substrate type being fused at a plurality of fuser temperatures, and the media substrate types measured for shrinkage subsequent to fusing, wherein each media substrate type is fused at a plurality of temperature uniformity conditions associated with the fuser, and wherein the characterization data is generated by averaging each media substrate type shrinkage associated with the plurality of fuser temperature uniformity conditions.

* * * * *